US006231046B1

(12) United States Patent
Tien

(10) Patent No.: US 6,231,046 B1
(45) Date of Patent: May 15, 2001

(54) STRUCTURE OF A SOCCER GAME TABLE

(76) Inventor: Feng-Yi Tien, P.O. Box 82-144, Taipei (TW)

( * ) Notice: Subject to any disclaimer, the term of this patent is extended or adjusted under 35 U.S.C. 154(b) by 0 days.

(21) Appl. No.: 09/407,871

(22) Filed: Sep. 29, 1999

(51) Int. Cl.[7] ..... A63F 7/06
(52) U.S. Cl. ..... 273/108.52; 273/108.54
(58) Field of Search ..... 273/108.51, 108.52, 273/108.53, 108.54, 108.55, 108.56, 118 R, 126 R, 85 A, 85 B, 85 C, 85 D, 85 E, 85 F, 108.1

(56) References Cited

U.S. PATENT DOCUMENTS 2,215,687 * 9/1940 Carter .
3,920,244 * 11/1975 Kaiser .
4,127,269 * 11/1978 Rest .
4,138,110 * 2/1979 Hendrickson .
5,137,276 * 8/1992 Monneret .
5,333,864 * 8/1994 McCloud .
5,377,981 * 1/1995 Monneret .

FOREIGN PATENT DOCUMENTS

3046466 * 7/1982 (DE) ..... 273/85 D

* cited by examiner

*Primary Examiner*—Sebastiano Passaniti
(74) *Attorney, Agent, or Firm*—A & J

(57) ABSTRACT

An improved soccer game table includes a rectangular box-like member, a plurality of axially slidable actuating rods mounted extending transversely of the rectangular box-like member, and a plurality of playing figures mounted on said actuating rods, wherein the playing figures can be randomly arranged on the actuating rods as desired.

4 Claims, 6 Drawing Sheets

STRUCTURE OF A SOCCER GAME TABLE

BACKGROUND OF THE INVENTION

1. Field of the Invention

This invention is related to an improvement in the structure of a soccer game table and in particular to one which enables a player to deploy the playing figures in different formations.

2. Description of the Prior Art

The conventional soccer game table generally includes a rectangular, box-like playing area supported on four angularly mounted and reinforced legs, a plurality of axially slidable actuating rods are mounted extending transversely of the playing area, and a plurality of playing figures mounted on the actuating rods. However, the playing figures arranged above the playing surface of the table in a fixed formation which cannot be changed as desired thereby making the game dull and monotonous.

Therefore, it is an object of the present invention to provide an improvement in the structure of a soccer game table which can obviate and mitigate the above-mentioned drawbacks.

SUMMARY OF THE INVENTION

This invention is related to an improvement in the structure of a soccer game table.

According a preferred embodiment of the present invention, an improved soccer game table includes a rectangular box-like member, a plurality of axially slidable actuating rods mounted extending transversely of the rectangular box-like member, and a plurality of playing figures mounted on said actuating rods, wherein the playing figures can be randomly arranged on the actuating rods as desired It is the primary object of the present invention to provide an improved soccer game table which enables a player to deploy the playing figures in different formations as desired.

It is another object of the present invention to provide an improved soccer game table of which the playing figures can be arranged on different positions on the actuating rods.

It is still another object of the present invention to provide an improved soccer game table which can be controlled to kick up the ball.

It is still another object of the present invention to provide an improved soccer game table of which the playing figures have replaceable feet.

It is still another object of the present invention to provide an improved soccer game table of which the playing figures can be arranged at a horizontal position It is still another object of the present invention to provide an improved soccer game table which can simulate a real soccer game.

It is a further object of the present invention to provide an improved soccer game table which will give a lot of fin to the player.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
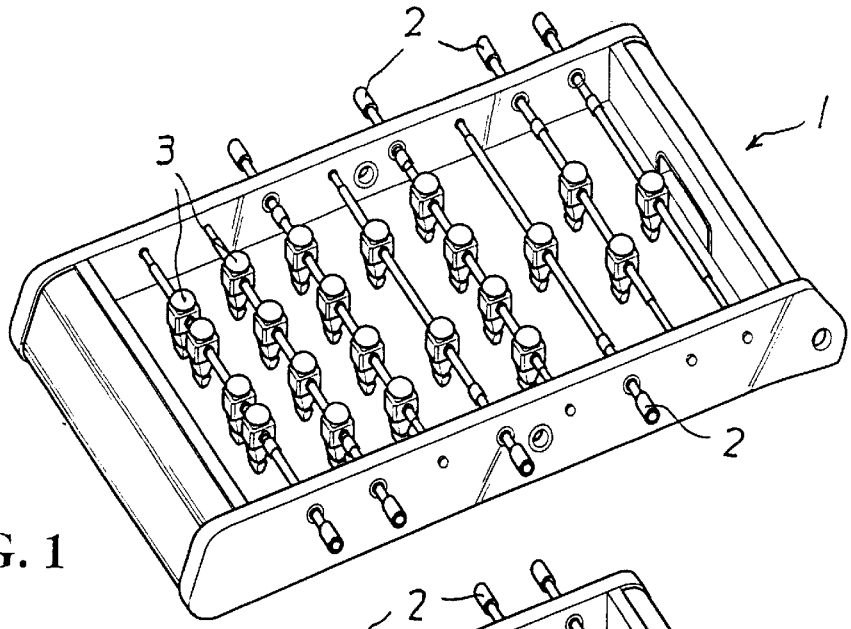
FIGS. 1, 2, 3, 4, 5 and 6 illustrate the playing figures deployed in different formations.
Figure 2:
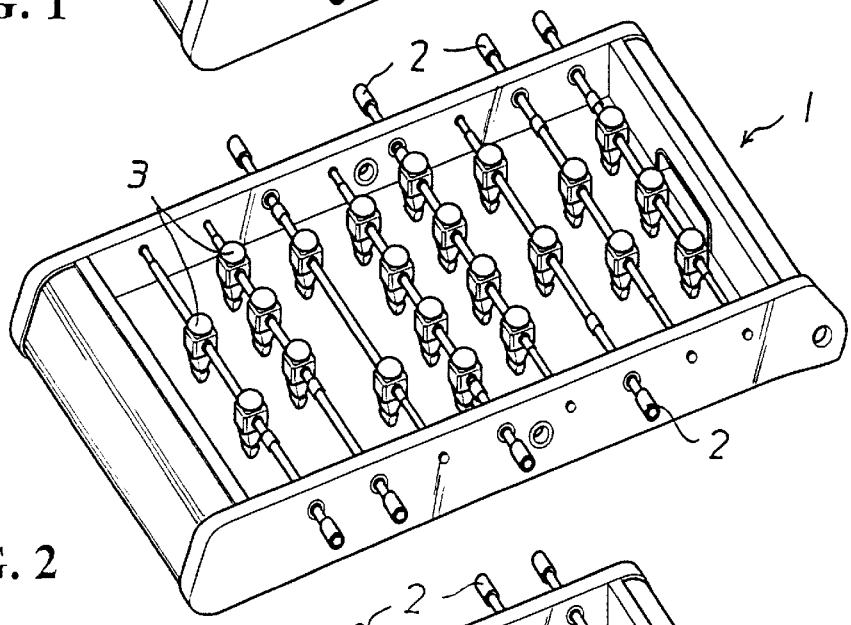
Figure 3:
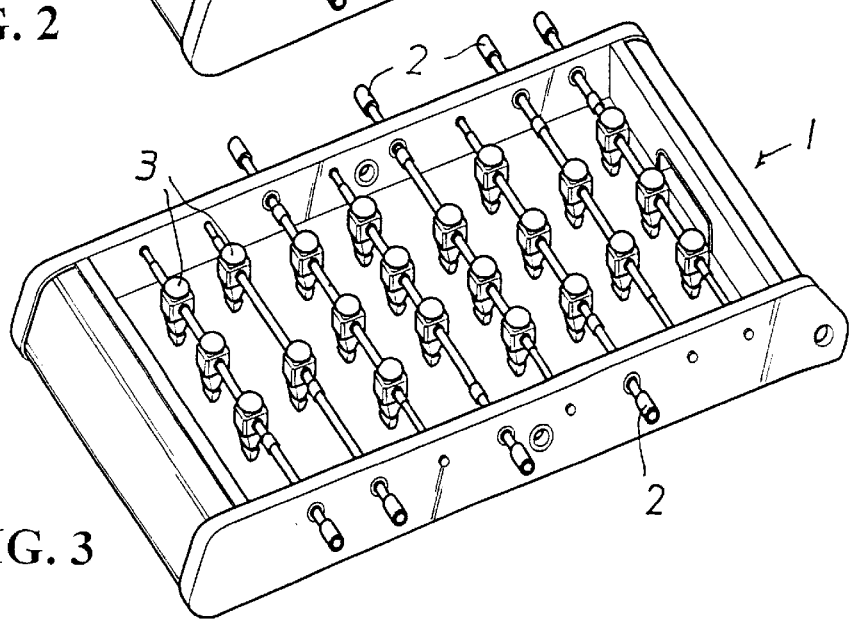

Referring first to FIGS. 1, 2, 3, 4, 5 and 6, the playing figures 3 of the soccer game table according to the present invention can be deployed in different formations as desired.

As shown in FIG. 1, the playing figures 3 in left side of the soccer game table are arranged in 1-2-4-4 defense formation, while the playing figures 3 in the right side of the soccer game table are deployed in 4-4-2-1 attack formation.

As shown in FIG. 2, the playing figures 3 in left side of the soccer game table are arranged in 2-4-3-2 formation, while the playing figures 3 in the right side of the soccer game table are deployed in 2-4-2-3 formation.

Figure 4:
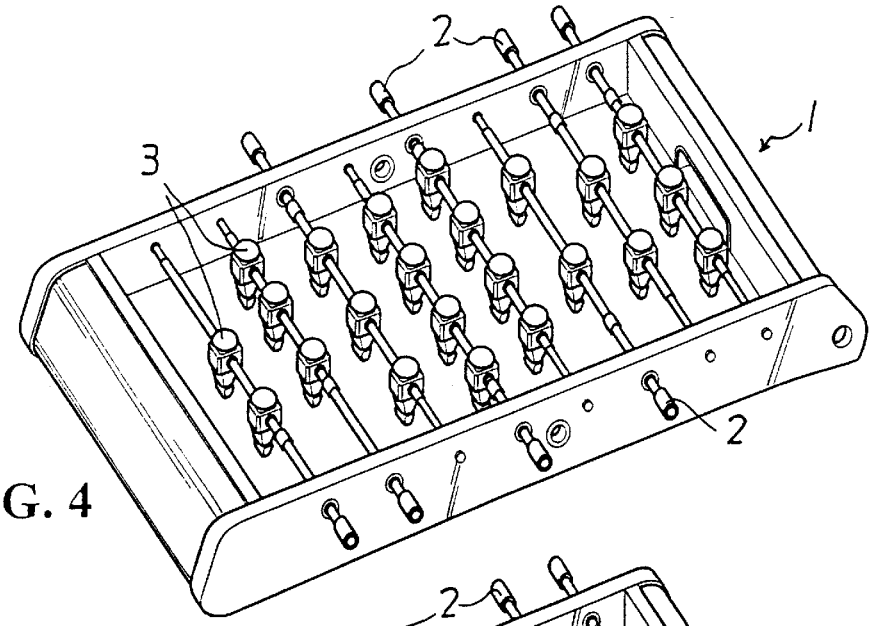
Figure 5:
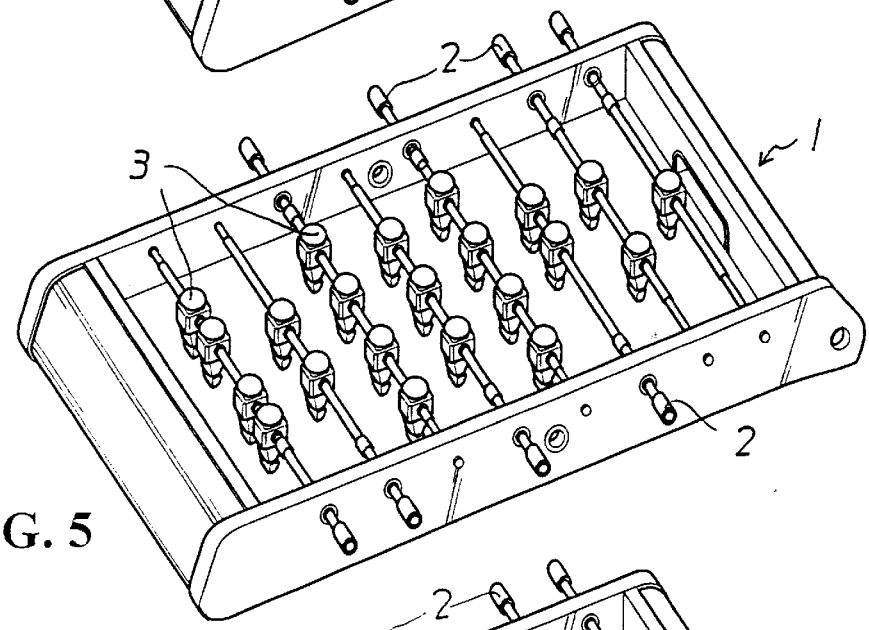
Figure 6:
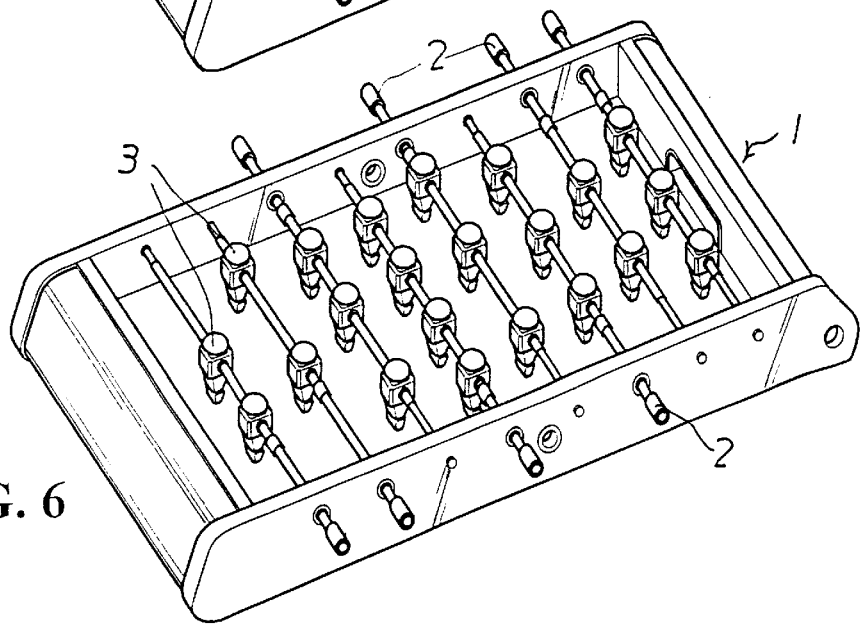

As shown in FIG. 3, the playing figures 3 in both sides of the soccer game table are arranged in 3-3-2-3 formation. As shown in FIG. 4, the playing figures 3 in left side of the soccer game table are arranged in 2-4-3-2 formation, while the playing figures 3 in the right side of the soccer game table are deployed in 3-4-2-3 formation. As shown in FIG. 5, the playing figures 3 in left side of the soccer game table are arranged in 2-3-2-4 formation, while the playing figures 3 in the right side of the soccer game table are deployed in 4-4-2-1 formation. As shown in FIG. 6, the playing figures 3 in left side of the soccer game table are arranged in 3-4-2-2 formation, while the playing figures 3 in the right side of the soccer game table are deployed in 3-3-2-3 formation.

The soccer game table according to the present invention generally comprises a rectangular box-like member (shown but not numbered), a plurality of axially slidable actuating rods 2 mounted extending transversely of the rectangular box-like member, and a plurality of playing figures 3 mounted on the actuating rods 2.

Figure 7:
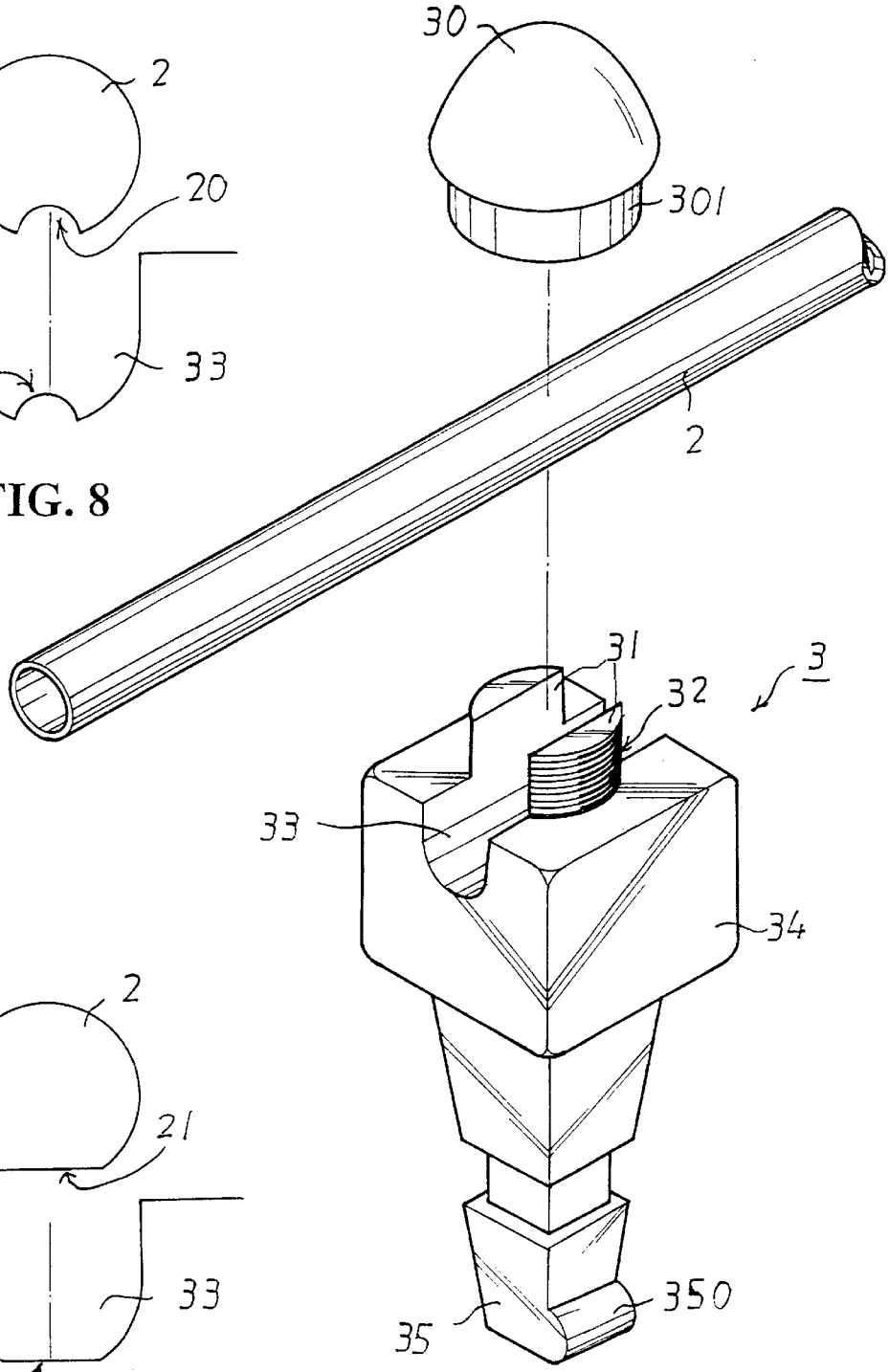
FIG. 7 is an exploded view showing the relationship between the actuating rod and the playing figure.

Referring to FIG. 7, the playing FIG. 3 comprises a head 30, a body 34 and a foot 35. The head 30 is formed at the lower portion with a neck 301 having an internal threaded hole 300 (see FIG. 10) which is open at the bottom. The body 34 has an upper threaded end 31 configured to engage with the internal threaded hole 300 of the head 30 and divided into two halves by a slot 33 adapted to receive an actuating rod 2. The foot 35 is provided with a projection 350 at the lower portion.

In assembly, the actuating rod 2 is first fitted in the slot 33 of the body 34 of the playing FIG. 3 and then the head 30 is engaged with the upper threaded end 32 of the body 34 to fasten the actuating rod 2 in the body 34. Hence, the playing FIG. 3 can be arranged at any desired position on the actuating rod 2 by loosening the head 30 thereby enabling a player to deploy the formation of the playing figures as desired.

Figure 8:
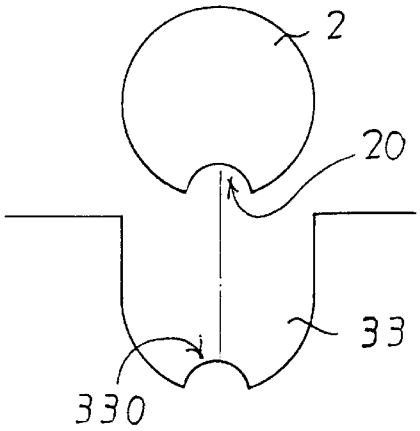
FIG. 8 illustrates a second preferred embodiment of the present invention.
Figure 9:
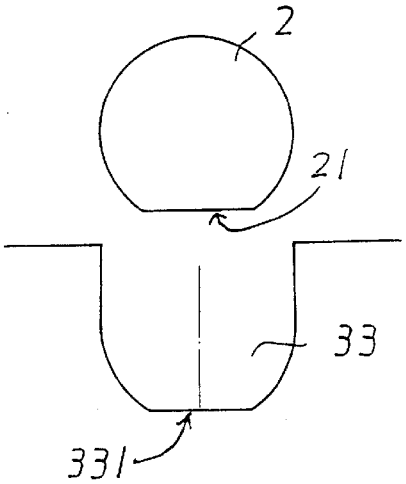
FIG. 9 illustrates a third preferred embodiment of the present invention.

FIG. 8 illustrates a second preferred embodiment of the present invention. As shown, the bottom of the actuating rod 2 is formed with a circular recess 20 configured to engage with a circular protuberance 330 on the bottom of the slot 33 of the playing FIG. 3. FIG. 9 illustrates a third preferred embodiment of the present invention, wherein the actuating rod 2 has a flat bottom 21 adapted to engage with a flat the bottom 331 of the slot 33 of the playing FIG. 3.

Figure 11:
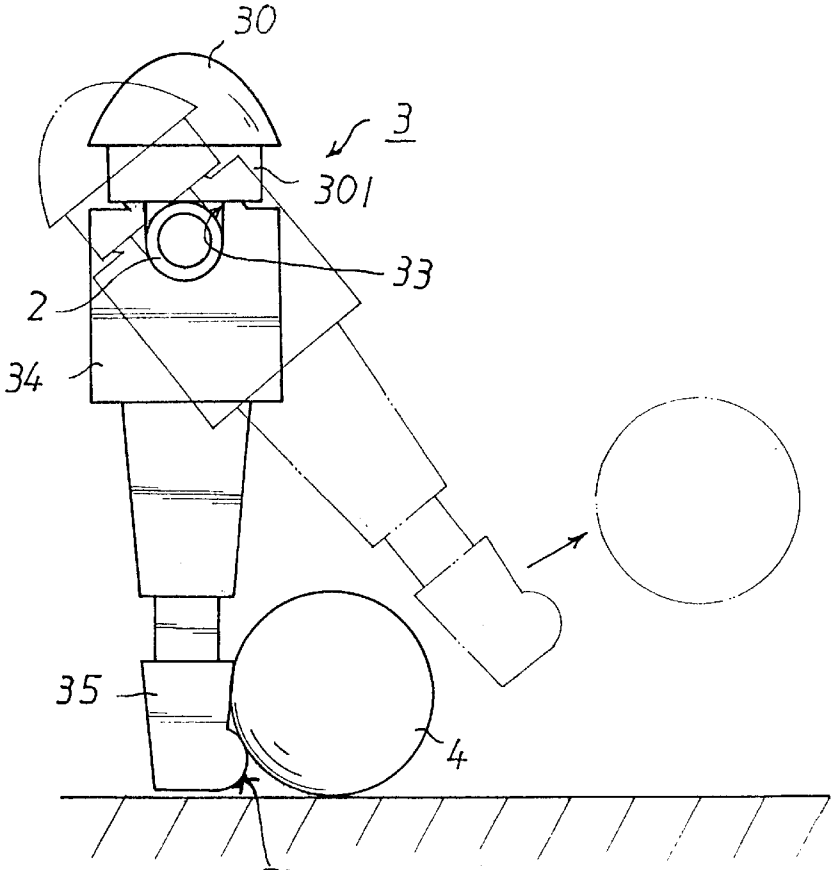
FIGS. 10 and 11 illustrate different kicks of the present invention.
Figure 10:
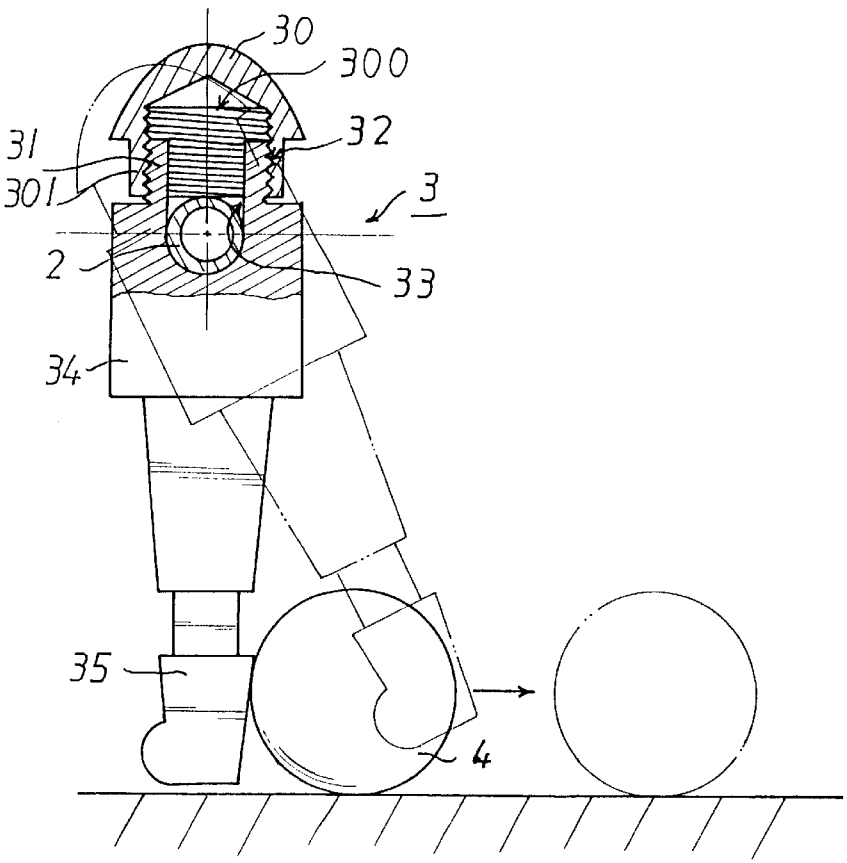

Turning to FIG. 10, the playing FIG. 3 is arranged to locate the projection 350 of the foot 35 at the rear side so that when the ball 4 is kicked by the flat surface of the foot 35, it will go forward along the surface of the soccer game table. However, if the playing FIG. 3 is arranged to locate the projection 350 of the foot 35 at the front side so that when the ball 4 is kicked by the projection 350 of the foot 35, it will go upwardly along a projectile path as shown in FIG. 11.

The head 30 of the playing FIG. 3 may be made of heavy material so that the playing FIG. 3 can be kept at a horizontal position thereby enabling it to simulate the tackling action and therefore increasing the fun.

Figure 12:
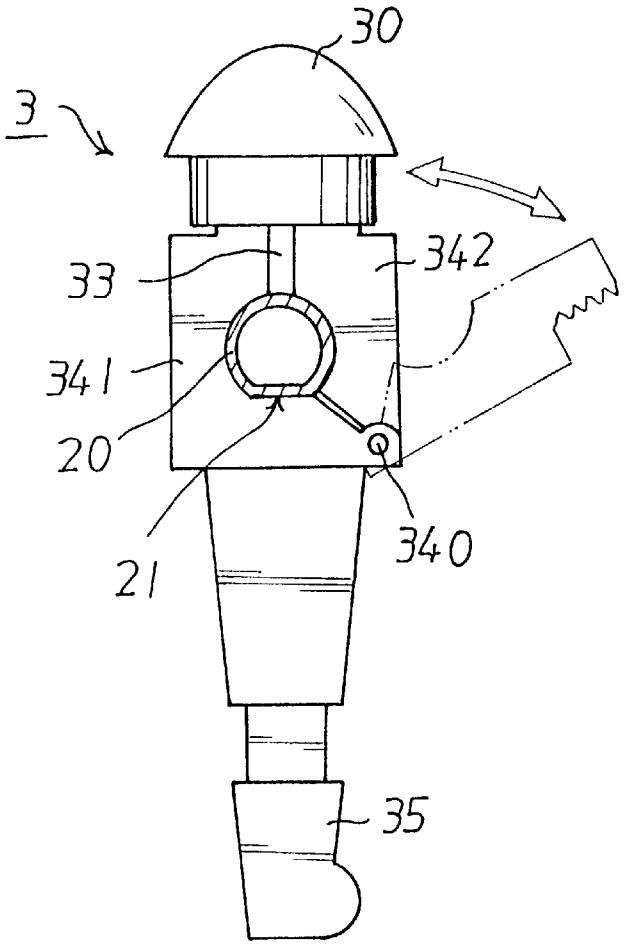
FIG. 12 illustrates a fourth preferred embodiment of the present invention.

FIG. 12 illustrates a fourth preferred embodiment of the present invention. As shown, the body of the playing FIG. 3 may be composed a left body 341 and a right body 342 pivotally to the left body 341 by a pin 340. The actuating rod 20 is clamped between the left and right bodies 341 and 342. The left and right bodies 341 and 342 are provided with threaded upper ends configured to engage with the head 30.

Figure 13:
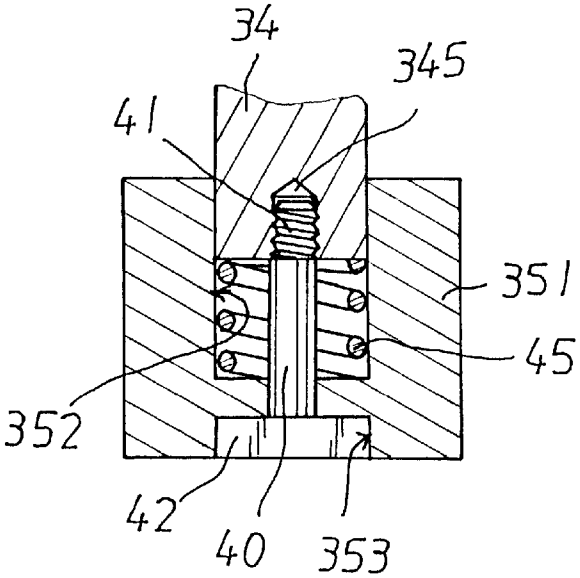
FIG. 13 is a sectional view of a fifth preferred embodiment of the present invention.
Figure 14:
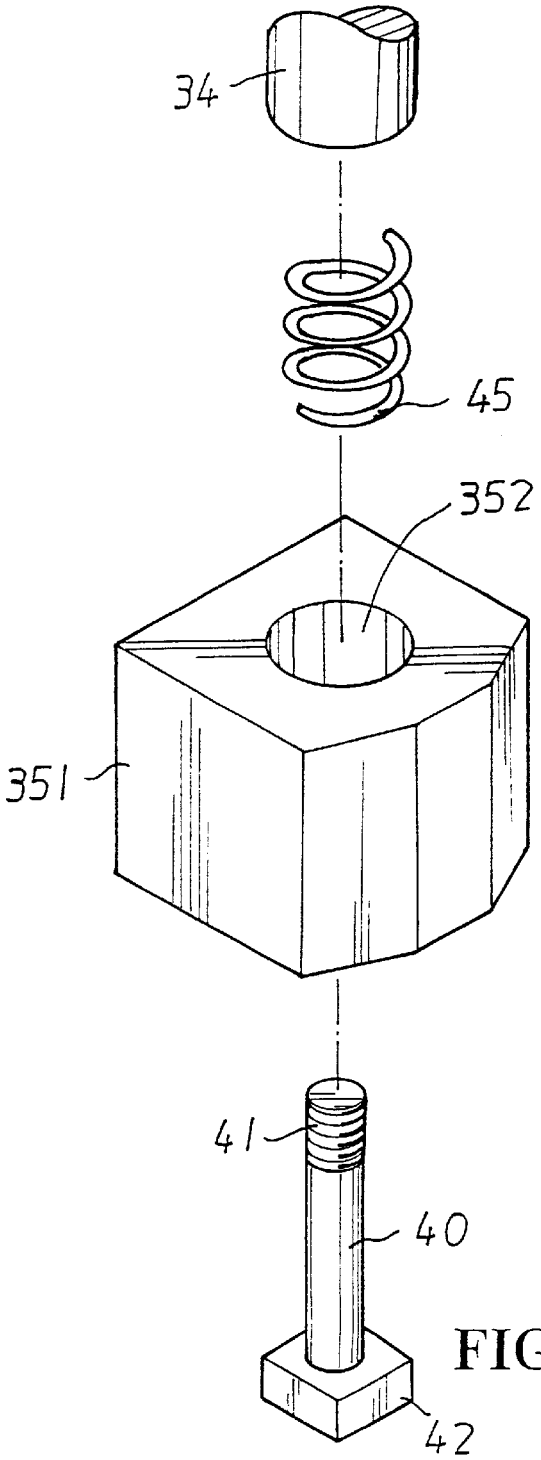
FIG. 14 is an exploded view of the fifth preferred embodiment of the present invention.
Figure 15:
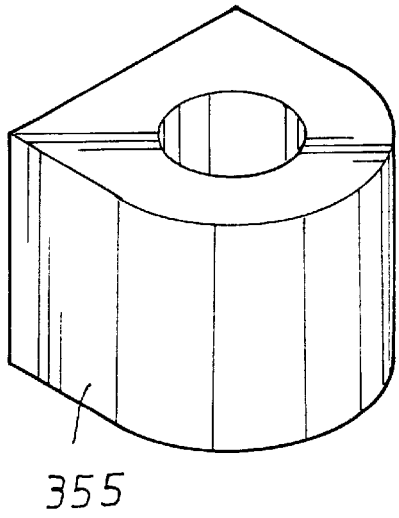
FIG. 15 is a perspective view of a sixth preferred embodiment of the present invention.

FIGS. 13 and 14 illustrate a fifth preferred embodiment of the present invention. As shown, the foot 351 may be of angular surfaces (see FIG. 14) a circular surface (see FIG. 15), or the like. The foot 351 has a hole 352 in which are fitted a spring 45 and a lower end of a circular rod 34 extending downwardly from the body of the playing figure. The lower end of the circular rod 34 is formed with a threaded center hole 345 in which is threadedly engaged with a threaded upper end 41 of a bolt 40. The bolt 40 has a rectangular cap 42 adapted to fit into a rectangular recess 353 at the bottom of the foot 351. When desired to dismount the foot 351 from the playing FIG. 3, it is only necessary to push the foot 351 upwardly to disengage the cap 42 of the bolt 40 from the foot 351 and then turn the bolt 40 to disengage the foot 351 from the circular rod 34. Accordingly, the foot 351 can be easily disengaged from the playing figure and replaced with another one with different configuration as desired.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a soccer game table comprising a rectangular box member, a plurality of axially slidable actuating rods mounted extending transversely of the rectangular box member, and a plurality of playing figures mounted on said actuating rods, wherein said playing figures comprise a head having a lower portion provided with an internally threaded neck, and a body having a foot and an upper externally threaded end engageable with said internally threaded neck and having a slot for receiving one of said actuating rods, said body comprises a head and two halves pivotally joined together by a pin, between which is fitted one of said actuating rod, said halves being provided with threaded upper ends configured to engage with said head, whereby said playing figures can be randomly arranged on said actuating rods as desired.

2. The playing figures as claimed in claim 1, wherein said slot has a bottom formed with a circular protuberance or a flat surface and said actuating rods have a bottom configured to engage with said circular protuberance or said flat surface.

3. The playing figures as claimed in claim 1, wherein said foot has a lower end provided with a projection.

4. The playing figures as claimed in claim 1, wherein said foot is fastened to a bottom of said body by a bolt.

* * * * *